US008413304B1

(12) United States Patent
Tipton et al.

(10) Patent No.: US 8,413,304 B1
(45) Date of Patent: Apr. 9, 2013

(54) SEATBELT GRIPPING DEVICE FOR VEHICLE ENTRANCE ASSISTANCE

(76) Inventors: Rickey Tipton, Kalamazoo, MI (US); Theresa Tipton, Kalamazoo, MI (US)

( * ) Notice: Subject to any disclaimer, the term of this patent is extended or adjusted under 35 U.S.C. 154(b) by 400 days.

(21) Appl. No.: 12/856,400

(22) Filed: Aug. 13, 2010

(51) Int. Cl.
*B25G 1/10* (2006.01)

(52) U.S. Cl. ..... 16/430; 16/422; 16/426

(58) Field of Classification Search ..... 16/110.1, 16/406, 413, 419, 422, 426, 428, 430, 114.1
See application file for complete search history.

(56) References Cited

U.S. PATENT DOCUMENTS 5,248,187 A * 9/1993 Harrison ..... 297/482
D352,591 S * 11/1994 Laney ..... D2/631
D393,337 S * 4/1998 Seki ..... D2/624
6,343,841 B1 * 2/2002 Gregg et al. ..... 297/468
7,533,901 B2 * 5/2009 David et al. ..... 280/801.1
2009/0261565 A1 * 10/2009 David et al. ..... 280/801.1

* cited by examiner

*Primary Examiner* — Roberta Delisle

(57) ABSTRACT

A gripping device for helping an individual pull him or herself into a vehicle (with limited or no assistance. The device features a strap having a first end and a second end; a handle grip disposed on the first end of the strap; and an anchor clip disposed on the second end of the strap. The handle grip comprises a first center hole for providing a means for a user to grip the handle grip. One or more grooves are disposed on at least a portion of the first center hole. The anchor clip resembles a standard tongue of a standard seat belt. A second center hole is disposed in the anchor clip adapted to engage a buckle of a standard seat belt.

11 Claims, 3 Drawing Sheets

SEATBELT GRIPPING DEVICE FOR VEHICLE ENTRANCE ASSISTANCE

FIELD OF THE INVENTION

The present invention is directed to a vehicle accessory, more particularly to a device for engaging a seatbelt, more particularly to a device that can help an individual pull him/herself into a vehicle with limited to no assistance.

BACKGROUND OF THE INVENTION

Individuals with limited mobility, such as individuals recovering from an injury or surgery (e.g., joint surgery), elderly individuals, and/or overweight individuals, may have difficulty getting into a vehicle (e.g., car, truck, etc.) The present invention features a seatbelt gripping device (e.g., vehicle entrance assistance device) for helping an individual pull him or herself into a vehicle (e.g., car, truck, etc.) with limited or no assistance. The gripping device of the present invention engages the buckle of a seat belt in a vehicle, providing the user with a device onto which he/she can grab and pull him/herself into the vehicle.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
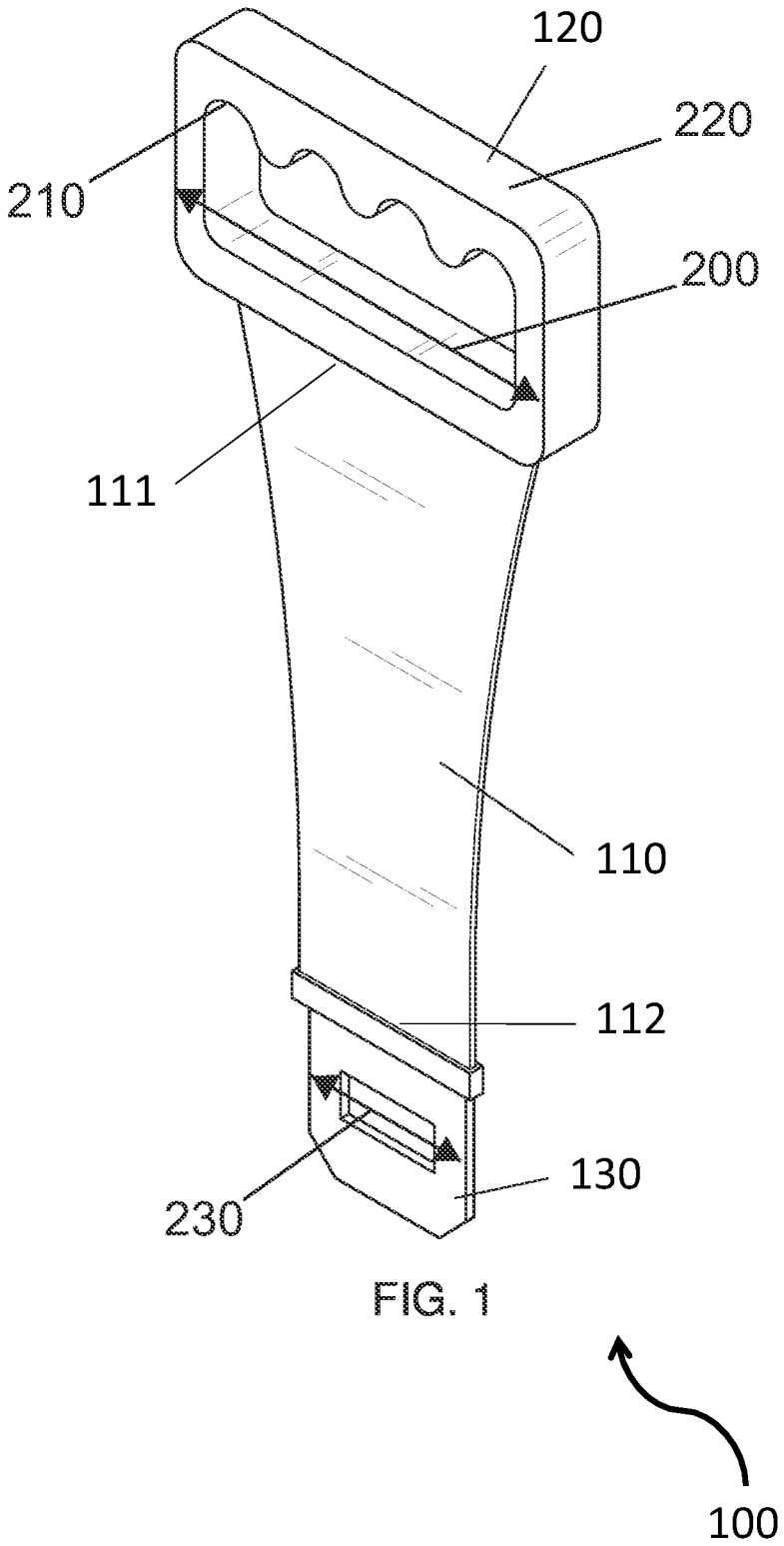
FIG. 1 is a perspective view of the seatbelt gripping device of the present invention.
Figure 2:
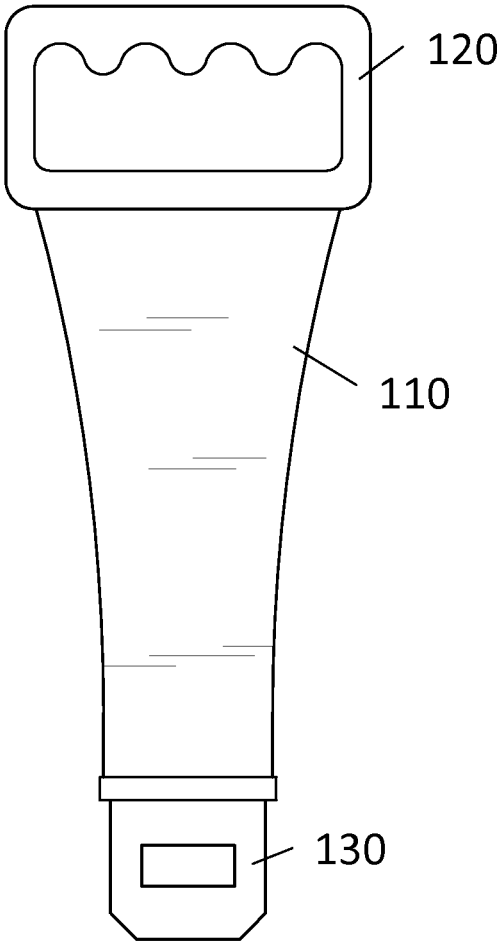
FIG. 2 is a front view of the seatbelt gripping device of the present invention.
Figure 3:
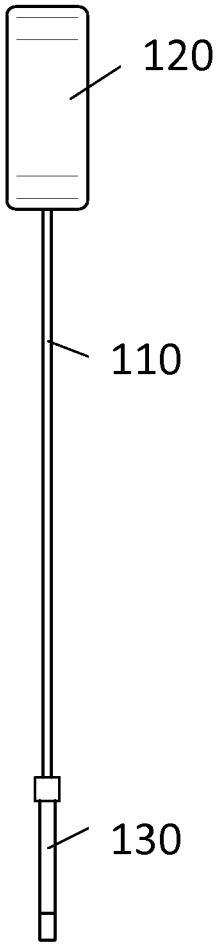
FIG. 3 is a side view of the seatbelt gripping device of the present invention.
Figure 4:
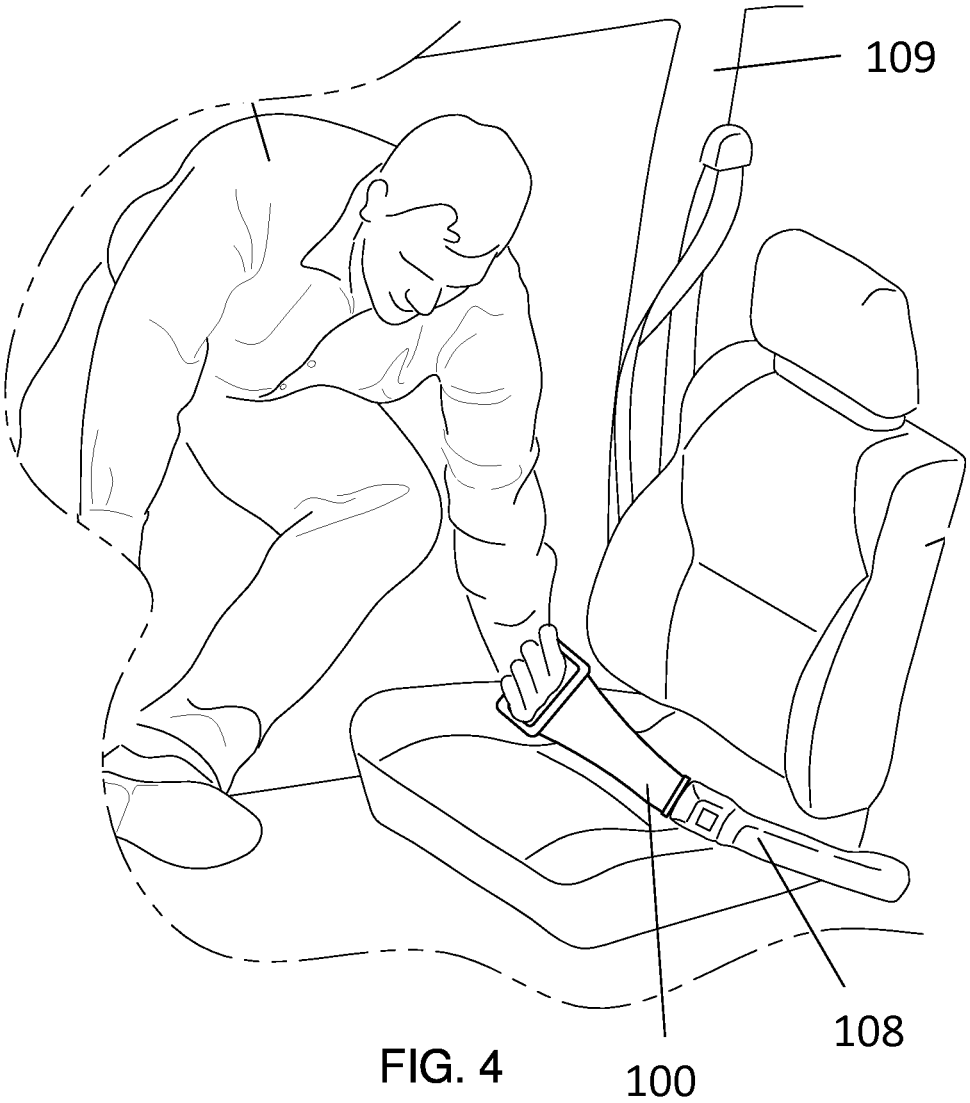
FIG. 4 is an in-use view of the seatbelt gripping device of the present invention.

Referring now to FIGS. 1-4, the present invention features a seatbelt gripping device 100 (e.g., a vehicle entrance assistance device) for helping an individual pull him or herself into a vehicle (e.g., car, truck, etc.) with limited or no assistance. The device engages a seatbelt in the vehicle, providing the user with a device onto which he/she can grab and pull him/herself into the vehicle.

The gripping device 100 comprises a strap 110 having a first end 111 and a second end 112. The strap 110 may be constructed in a variety of lengths to suit a user's needs. The strap 110 may be constructed in a variety of sizes. In some embodiments, the strap 110 is adjustable in length. In some embodiments, the strap 110 is between about 6 to 10 inches in length as measured from the first end 111 to the second end 112. In some embodiments, the strap 110 is between about 10 to 16 inches in length as measured from the first end 111 to the second end 112. In some embodiments, the strap 110 is more than about 16 inches in length. In some embodiments, the first end 111 of the strap 110 is wider than the second end of the strap 112 (see FIG. 1). In some embodiments, the strap 110 is constructed from a material comprising plastic, for example to help prevent the strap from folding. The construction of the strap 110 is not limited to the aforementioned materials.

A handle grip 120 having a handle grip width 200 is located on the first end 111 of the strap 110. The handle grip 120 is shaped and sized to accommodate a user's hand. For example, a user can wrap his/her hand around the handle grip 120. In some embodiments, the handle grip 120 is constructed in a generally oval shape, a circular shape, or a rounded rectangular shape (or a variation thereof, including irregular shapes) and has a first center hole centrally located on the handle grip. The first center hole may provide a means for a user to grip onto the handle grip 120. In some embodiments, one or more grooves are disposed on an inside surface 210 on the handle grip 120 on an outside wall 220, for example along all or a portion of a top edge and/or along all or a portion of the first center hole, to provide a comfortable grip for the user. Such grooves are well known to one of ordinary skill in the art.

Disposed on the second end 112 of the strap 110 is an anchor clip 130 having an anchor clip width 230. The anchor clip 130 is adapted to engage the buckle 108 of a seat belt in a vehicle 109, for example the anchor clip 130 resembles the tongue of a standard seat belt, which is well known to one of ordinary skill in the art. For example, the anchor clip 130 is generally rounded rectangular shape and has a second center hole, the second center hole being the component that engages the spring-loaded button of the buckle 108 of the seat belt. In some embodiments, the handle grip width 200 is at least two times the anchor clip width 230. In some embodiments, the handle grip thickness is at least two times the anchor clip thickness.

To use the device 100 of the present invention, the anchor clip 130 is clipped into the buckle 108 of a seatbelt in the vehicle. The user grabs the handle grip 120 and pulls him/herself into the vehicle. Once in the vehicle, the buckle 108 of the seat belt is pressed to disengage the anchor clip 130 from the buckle. Then the user can clip in the tongue of the seat belt into the buckle 108 of the seat belt to fasten the seat belt normally.

As used herein, the term "about" refers to plus or minus 10% of the referenced number. For example, an embodiment wherein the strap 110 is about 10 inches in length includes a strap 110 that is between 9 and 11 inches in length.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A gripping device comprising:

(a) a strap having a first end and a second end;

(b) a handle grip having a handle grip width disposed on the first end of the strap, the handle grip comprises a first center hole centrally disposed in the handle grip, the first center hole may provide a means for a user to grip the handle grip, wherein one or more grooves are disposed on an inside surface of the first center hole on an outside wall; and (c) an anchor clip having an anchor clip width disposed on the second end of the strap, the anchor clip resembles a standard tongue of a standard seat belt, wherein a second center hole is disposed in the anchor clip, the anchor clip is adapted to engage a buckle of a standard seat belt;

wherein the handle grip width is at least two times the anchor clip width.

2. The gripping device of claim 1, wherein the strap is constructed from a material comprising plastic.

3. The gripping device of claim 1, wherein the handle grip is constructed in a generally oval shape, a circular shape, or a rounded rectangular shape.

4. The gripping device of claim 1, wherein the anchor clip has a generally rounded rectangular shape.

5. A method of entering a vehicle, said method comprising:

(a) providing a gripping device comprising: a strap having a first end and a second end; a handle grip having a handle grip width disposed on the first end of the strap, the handle grip comprises a first center hole centrally disposed in the handle grip, the first center hole may provide a means for a user to grip the handle grip, wherein one or more grooves are disposed on an inside surface of the first center hole on an outside wall; and an anchor clip having an anchor clip width disposed on the second end of the strap, the anchor clip resembles a standard tongue of a standard seat belt, wherein a second center hole is disposed in the anchor clip;

(b) engaging the anchor clip into a buckle of a seat belt in the vehicle; and (c) gripping the handle grip and pulling oneself into the interior of the vehicle.

6. The method of claim 5 further comprising disengaging the anchor clip from the buckle of the seat belt in the vehicle.

7. The method of claim 6 further comprising snapping a tongue of the seat belt in the vehicle into the buckle of the vehicle.

8. The method of claim 5, wherein the strap is constructed from a material comprising plastic.

9. The method of claim 5, wherein the handle grip is constructed in a generally oval shape, a circular shape, or a rounded rectangular shape.

10. The method of claim 5, wherein the anchor clip has a generally rounded rectangular shape.

11. A gripping device consisting of:

(a) a strap having a first end and a second end;

(b) a handle grip having a handle grip width disposed on the first end of the strap, the handle grip consists of a first center hole centrally disposed in the handle grip, the first center hole may provide a means for a user to grip the handle grip, wherein one or more grooves are disposed on an inside surface of the first center hole on an outside wall; and (c) an anchor clip having an anchor clip width disposed on the second end of the strap, the anchor clip resembles a standard tongue of a standard seat belt, wherein a second center hole is disposed in the anchor clip, the anchor clip is adapted to engage a buckle of a standard seat belt;

wherein the handle grip width is at least two times the anchor clip width.

* * * * *